US005133831A

United States Patent [19]

Ryham

[11] Patent Number: 5,133,831

[45] Date of Patent: Jul. 28, 1992

[54] METHOD OF CONCENTRATING BLACK LIQUOR BY EVAPORATION

[75] Inventor: Rolf Ryham, Princeton, N.J.

[73] Assignee: Ahlströmföretagen Svenska AB, Norrköping, Sweden

[21] Appl. No.: 244,996

[22] Filed: Sep. 15, 1988

[51] Int. Cl.[5] ..... B01D 1/26; D21C 11/10; D21C 11/12

[52] U.S. Cl. ..... 159/47.3; 159/17.1; 159/46; 110/235; 110/238; 122/7 C; 162/30.1; 162/31; 162/47; 422/184; 422/185

[58] Field of Search ..... 159/47.3, 29, 17.1, 159/46; 162/47, 31, 30.1, 30.11; 110/238, 235; 122/7 C; 422/184, 185

[56] References Cited

U.S. PATENT DOCUMENTS

| | | | |
|---|---|---|---|
| 1,779,536 | 10/1930 | Goodell | 110/238 |
| 2,056,266 | 10/1936 | Goodell | 122/7 C |
| 2,755,749 | 7/1956 | Seymour | 159/47.3 |
| 2,928,184 | 3/1960 | Lonngren | 159/47.3 |
| 3,296,064 | 1/1967 | Cann | 159/47.3 |
| 3,299,942 | 1/1967 | Jacoby | 159/47.3 |
| 3,635,790 | 1/1972 | Heath | 162/30.1 |
| 3,703,919 | 11/1972 | Owens et al. | 159/47.3 |
| 4,085,688 | 4/1978 | Smith et al. | 162/29 |
| 4,347,220 | 8/1982 | Nelson et al. | 422/185 |
| 4,377,439 | 3/1983 | Liem | 162/30.11 |

FOREIGN PATENT DOCUMENTS 119215 7/1947 Sweden .

*Primary Examiner*—Wilbur Bascomb
*Attorney, Agent, or Firm*—Cohen, Pontani & Lieberman

[57] ABSTRACT

A method of drying black liquor to a dry solids content of about 100% in which water is evaporated from the black liquor by direct heat exchange contact with hot smelt from a recovery furnace in which the dried black liquor is burned.

9 Claims, 1 Drawing Sheet

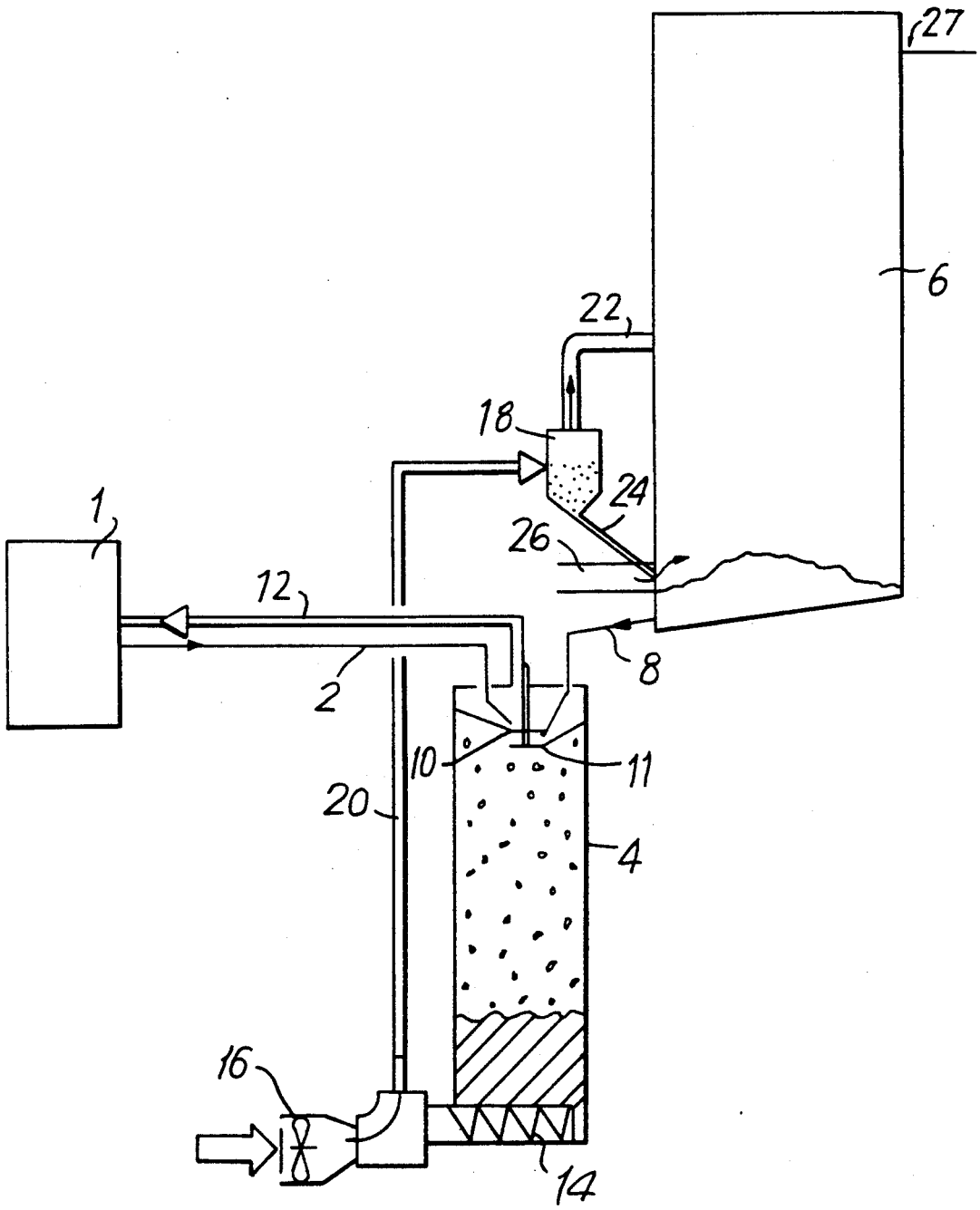
27
6
22
18
24
26
1
12
2
8
10
11
20
4
16
14

METHOD OF CONCENTRATING BLACK LIQUOR BY EVAPORATION

FIELD OF THE INVENTION

The present invention relates to process for the treatment of spent pulping liquor known as black liquor. More particularly the present invention relates process for the treatment of black liquor to achieve a high dry solids content of the black liquor before it is introduced into a recovery furnace.

BACKGROUND OF THE INVENTION

It is customary in the pulp and paper industry when producing chemical pulp to burn the used pulping liquor, i.e. the black liquor in a chemical and heat recovery furnace. In a conventional recovery furnace the process chemical is recovered by injecting black liquor at a dry solids content of about 65% into the furnace. As the liquor enters the furnace, it rapidly dries and burns under reducing conditions above the hearth whereby a smelt is formed which is discharged from the furnace. Oxygen is added in form of secondary air to burn the gases generated at a higher location in the furnace. The furnace is provided with heat exchange surfaces to recover heat and generate steam.

It is desirable that as much water as possible is removed from the black liquor before it is introduced into the recovery furnace as evaporation of the residual water of the black liquor in the furnace causes cooling and slowing of the combustion process. This involves, however, difficult handling problems. Black liquor goes into a semi-solid state at a dry solids content of about 60% and at about 80% DS it has a viscosity exceeding 500 cP at 100° C.

It is the prime object of the present invention to provide a method for concentrating black liquor to a high dry solids content, preferably to about 100%.

Earlier attempts to reduce the water content of the black liquor which is introduced into the recovery furnace have been made. U.S. Pat. No. 4,347,220 discloses a method in which sawdust is mixed with partially concentrated black liquor and dried by heated air.

It has also been proposed to evaporate water from black liquor by mixing the black liquor which has been previously concentrated by conventional evaporating methods with superheated steam under pressure. The released vapor is removed, heated and recycled. When the water content of the black liquor has been reduced by this treatment 0–20%, the black liquor is exhausted from the apparatus through a nozzle, whereby, as the pressure decreases, the remaining water vaporizes and a particulate, dry and non-sticky substance which can be burned in a furnace is produced. Such a method is described in the Swedish patent specification 119215.

DISCLOSURE OF THE INVENTION

According to the present invention smelt from the recovery furnace is used to evaporate water from partially concentrated black liquor. The black liquor is preferably dried to about 100% so as to form a dry, non-sticky, particulate material which can be easily handled. The dry black liquor can, if desired, be formed into pellets. No auxiliary material such as sawdust is needed.

The invention is described in more detail in the following with reference to the accompanying drawing, in which a preferred embodiment of the invention is illustrated.

BRIEF DESCRIPTION OF THE DRAWING

The drawing shows schematically a system for carrying out the process according to the invention.

DESCRIPTION OF THE PRESENTLY PREFERRED EMBODIMENT

Black liquor which has been preconcentrated in conventional evaporators 1 by indirect heat exchange with steam to a dry solids content of about 75% is supplied through a line 2 to a vessel 4. Hot smelt which runs out of a recovery furnace or boiler 6 is supplied through a line 8 to the same vessel. The smelt and the liquor are conducted to rotating discs 10 and 11, disposed in the upper part of the vessel. By the rotational movement of the discs droplets are produced, which are thrown out and fall down through the vessel 4 mixed with each other. By the time the droplets reach the bottom of the vessel, the sensible heat in the smelt has evaporated the water from the black liquor. The vapor generated thereby is removed through a line 12 connected to the top of the vessel and is used in the aforementioned preconcentration evaporators 1. The dry material which collects in the bottom part of the vessel in the form of pebbles is removed by a screw 14 and conveyed by an air stream produced by a fan 16 to a cyclone separator 18 through a line 20. Air which has been preheated by contact with the dried black liquor and separated from it, is removed from the cyclone through a line 22 connected to the top of the cyclone and introduced into the boiler as secondary air. The particulate material is removed at the bottom of the cyclone through a line 24 and introduced into the boiler by means of primary air supplied through a line 26. The dried black liquor is burned in the boiler in a manner known per se whereby part of the smelt so produced is used to dry the black liquor and part of the smelt is removed from the system to recover pulping chemicals. Flue gases produced in the boiler are removed via flue gas outlet 27, in a manner known in the art.

| Example: | |
|---|---|
| Flow of black liquor at 75% DS | 2 000 kg/ton pulp |
| Water to be evaporated | 500 kg/ton pulp |
| Heat required | 270 000 kcal/ton pulp |
| Smelt required at a temperature of 900° C. and having a specific heat of 0.3 | 1 200 kg/ton pulp |
| Smelt produced | 550 kg/ton pulp |
| Total smelt flow | 1 750 kg/ton pulp |

It should be understood that the preferred embodiments and example desired above are for illustrative purposes only and are not to be construed as limiting the scope of the invention which is properly delineated in the appended claims.

What is claimed is:

1. A method of treating black liquor comprising:

a) concentrating black liquor by evaporation by direct heat exchange contact with smelt discharged from a recovery furnace;

b) feeding the concentrated black liquor to said recovery furnace;

c) said concentrated black liquor in said recovery furnace to produce a smelt which is used in step a).

2. The method of claim 1, wherein the black liquor is concentrated to a dry solids content of about 100%.

3. The method of claim 1, wherein the black liquor has been preconcentrated to a dry solids content of about 60–80%, before it is brought into contact with the smelt.

4. The method of claim 3, wherein vapor generated in the step of concentrating the black liquor is used as a heating medium for pre-concentrating said black liquor to a dry solids content of about 60–80%.

5. The method of claim 1, further comprising a) feeding the concentrated black liquor to a particle separator by means of an air flow;

b) removing air and concentrated black liquor separately from the particle separator;

c) introducing the concentrated black liquor and primary air in the recovery furnace; and d) introducing the air removed from the particle separator as secondary air into the recovery furnace at a location above that of the primary air.

6. A method of treating black liquor comprising:

a) feeding black liquor into a recovery furnace;

b) burning said black liquor in said recovery furnace to produce a smelt;

c) discharging said smelt from said furnace;

d) introducing into an evaporation zone said smelt from said furnace and black liquor; and e) evaporating water from said black liquor introduced into said evaporation zone by direct heat exchange with said smelt discharged from said recovery furnace thereby concentrating said black liquor.

7. The method of claim 6 further comprising the steps of:

discharging said concentrated black liquor from said evaporation zone and introducing said concentrated black liquor into said recovery furnace.

8. The method of claim 1, wherein the black liquor has been pre-concentrated to a dry solids content of about 70–75%, before it is brought into contact with the smelt.

9. The method of claim 8, wherein the vapor generated in the step of concentrating the black liquor is used as a heating medium for pre-concentrating said black liquor to a dry solids content of about 70–75%.

* * * * *